US008403354B2

(12) United States Patent
Senner et al.

(10) Patent No.: US 8,403,354 B2
(45) Date of Patent: Mar. 26, 2013

(54) EMERGENCY RELEASE DEVICE FOR WINTER SPORTS EQUIPMENT

(75) Inventors: Veit Senner, Odelzhausen (DE); Wolfgang Schott, München (DE)

(73) Assignee: Technische Universitat Munich, Munich (DE)

( * ) Notice: Subject to any disclaimer, the term of this patent is extended or adjusted under 35 U.S.C. 154(b) by 197 days.

(21) Appl. No.: 12/864,443

(22) PCT Filed: Jan. 23, 2009

(86) PCT No.: PCT/EP2009/000427

§ 371 (c)(1), (2), (4) Date: Oct. 12, 2010

(87) PCT Pub. No.: WO2009/092596

PCT Pub. Date: Jul. 30, 2009

(65) Prior Publication Data

US 2011/0018233 A1 Jan. 27, 2011

(30) Foreign Application Priority Data

Jan. 25, 2008 (DE) ..... 10 2008 006 070

(51) Int. Cl.
*A63C 9/00* (2006.01)

(52) U.S. Cl. ..... 280/623; 280/627; 280/634

(58) Field of Classification Search ..... 280/611, 280/612, 625, 626, 623, 634, 627, 633
See application file for complete search history.

(56) References Cited

U.S. PATENT DOCUMENTS

| | | | | |
|---|---|---|---|---|
| 3,246,907 A | | 4/1966 | Chisholm | 280/11.35 |
| 3,528,672 A | | 9/1970 | Wunder | 280/11.35 |
| 3,787,868 A | | 1/1974 | Camp | 343/225 |
| 3,794,339 A | | 2/1974 | Smolka | 280/11.35 |
| 3,933,363 A | * | 1/1976 | Schweizer et al. | 280/626 |
| 4,159,124 A | * | 6/1979 | Salomon | 280/612 |
| 4,291,894 A | | 9/1981 | D'Antonio et al. | 280/612 |
| 4,361,344 A | | 11/1982 | Hull et al. | 280/613 |
| 4,545,598 A | * | 10/1985 | Spitaler et al. | 280/612 |
| 5,085,453 A | | 2/1992 | Bildner | 280/612 |
| 5,150,913 A | | 9/1992 | Hoelzl | 280/612 |
| 5,294,144 A | * | 3/1994 | Stepanek et al. | 280/612 |
| 5,362,087 A | | 11/1994 | Agid | 280/611 |
| 6,007,086 A | * | 12/1999 | Hopkins | 280/612 |
| 6,659,494 B1 | * | 12/2003 | Martin | 280/612 |

(Continued)

FOREIGN PATENT DOCUMENTS

| | | |
|---|---|---|
| DE | 1 603 001 | 6/1972 |
| DE | 2 219 415 | 12/1972 |

(Continued)

OTHER PUBLICATIONS

Search Report for PCT/EP2009/000427 filed Jan. 23, 2009, dated Jul. 21, 2009.

*Primary Examiner* — Hau Phan

(74) *Attorney, Agent, or Firm* — Wstman, Champlin & Kelly, P.A.

(57) ABSTRACT

The invention relates to an emergency release system for one or more pieces of winter sports equipment, such as skis, ski poles, snowboards, bindings and/or boots for skis or snowboards. It is equipped with a connection mechanism for detachably connecting at least two elements of one or more pieces of winter sports equipment, wherein the connection mechanism is supported substantially radially in or on one of the two elements, and a drive mechanism, which can be activated from outside and is suited for cancelling the radial support of the connection mechanism, accordingly causing the two elements to separate. The invention also relates to a release method and a manufacturing process for such an emergency release system.

24 Claims, 9 Drawing Sheets

U.S. PATENT DOCUMENTS

| | | | | |
|---|---|---|---|---|
| 6,769,711 | B1 * | 8/2004 | Martin et al. | 280/625 |
| 7,073,812 | B2 * | 7/2006 | Rigal et al. | 280/611 |
| 7,104,564 | B2 * | 9/2006 | Martin et al. | 280/625 |
| 7,815,213 | B2 * | 10/2010 | Damiani et al. | 280/611 |
| 7,841,614 | B2 * | 11/2010 | Damiani et al. | 280/611 |

FOREIGN PATENT DOCUMENTS

| | | | |
|---|---|---|---|
| DE | 2416424 | | 11/1974 |
| DE | 24 02 684 | A1 | 7/1975 |
| DE | 25 19 544 | | 11/1975 |
| DE | 2717624 | | 11/1977 |
| DE | 38 08 643 | C1 | 4/1989 |
| DE | 44 46 260 | A1 | 8/1995 |
| DE | 102007001599 | | 7/2007 |
| EP | 0 228 599 | A2 | 12/1986 |
| FR | 2519258 | | 7/1983 |
| WO | WO 95/12440 | | 5/1995 |

* cited by examiner

EMERGENCY RELEASE DEVICE FOR WINTER SPORTS EQUIPMENT

CROSS-REFERENCE TO RELATED APPLICATION

This application is a Section 371 National Stage Application of International Application No. PCT/EP2009/000427, filed Jan. 23, 2009 and published as WO 2009/092596 on Jul. 30, 2009, the contents of which are hereby incorporated by reference in their entirety.

BACKGROUND

The present invention relates to an emergency release system for one or more pieces of winter sports equipment, such as skis, ski poles, snowboards, bindings and/or boots for skis or snowboards. In particular, it relates to an electrically controllable emergency release system which realizes such a separation in avalanche situations and also in other emergency situations (e.g. in case it is not possible to open the binding manually). The present invention also relates to a release method and a process for manufacturing winter sports equipment.

According to a Swiss statistic for the years 1980 to 1999 (F. Tschirky et al., Swiss Institute for Snow and Avalanche Research, CH-7260 Davos Dorf, Switzerland), the chance of survival of persons caught by avalanches is 83% in total. However, for persons who were completely buried, said chance is only 50%. There are two reasons: persons remaining at the surface can be rescued more quickly by companions and often there is a residual supply of oxygen at the surface. If the persons are deeply buried, the pressure load of the snow masses covering them often also causes injuries or kills them. Survival in an avalanche depends on several factors. For example, dead by avalanches is caused in about 70% by acute suffocation, in about 20% by a fatal trauma and in about 10% by the so-called 3-H syndrome (hypoxia, hypercapnia, hypothermia).

Thus, in an avalanche situation it is of outmost importance to remain as long as possible (at best completely) at the surface of the snow. A recommendation for an avalanche situation therefore is to keep oneself at the surface by making swimming movements (flowing snow masses tend to have the characteristics of a fluid). For, firstly, effective swimming movements being at all possible and, secondly, an anchoring effect generated by skis and ski poles or by the snowboard not being caused, it is urgently necessary to separate person and equipment from one another. Caused by the so-called inverse segregation effect, large parts (such as the body of a skier) are moved rather to the surface. An anchorage caused, e.g., by the ski with relatively deep snow layers is disadvantageous to this effect. The versed sportsman/sportswoman can first try to escape the snow masses by a rapid schuss. As soon as he/she fails, however, he/she must be separated from his/her equipment as quickly as possible upon his/her "release command". In such situations, it is as a rule impossible to separate oneself from the ski by releasing the ski binding. Reason: in the flowing medium "avalanche" there are at first only relatively small forces which cannot release the force- or moment-controlled ski bindings that are common nowadays. When the snow masses have compacted such that the resulting forces are sufficient for releasing the binding, it is in most cases too late for being freed.

For preventing the greatest risk—death by suffocation—it is tried, i.a., to reduce the degree of burial by means of additional safety equipment, such as the avalanche airbag (comprising two folded plastic balloons which are integrated at the sides of a backpack and, after pulling a trigger line, are inflated within 2 to 3 seconds by 150 liters of an nitrogen/air mixture; see also www.abs-lawinenairbag.de) or the life vest Avagear™ (here the balloons surround the shoulder and neck region; see also www.avagear.net). The effectiveness of both devices is based on the principle of the above-mentioned inverse segregation in granular flows.

On the basis of first field tests and evaluations of accident data by the Swiss Institute for Snow and Avalanche Research it is assumed that airbag users have all in all a lower risk to die in avalanche accidents. Nevertheless, in particular the anchoring effect caused by skis and ski poles can be disadvantageous to the inverse segregation effect and prevent the skier having the accident from making swimming movements in order to remain on top of the snow.

It is known to integrate sensors and electronic equipments into releasable alpine bindings in order to avoid mechanical overloads on bones or ligaments. Additionally using electrically ignitable explosive charges for releasing a safety binding for skis is known, i.a., from the following documents: published German patent application DE 2 416 424 teaches a safety fastener, in particular a safety binding for skis, with automatic opening upon the occurrence or under the action of predetermined critical outside influences. The unlocking means can comprise a pyrotechnical charge and means for igniting this charge.

Published German patent application DE 25 19 544 relates to a safety binding for skis, in particular to a device for electrically releasing a ski binding. The control means can comprise an electrically ignited cartridge or an electrically controlled explosive means.

German patent DE 27 17 624 claims an explosive charge release means for a latching means, in particular for a safety binding for skis, comprising a release member acting on the latch of the latching means, a storage for a plurality of cartridges comprising the explosive charges, and a reloading means for successively moving the cartridges into an operating position.

German patent DE 44 46 260 relates to an electronically controlled safety binding for skis and snowboards, in which the forces are measured electronically by means of piezo crystals and the binding is opened quickly by means of an explosive or propelling charge if forces occur which are dangerous to the skier or snowboarder. Moreover, the binding comprises springs for being released mechanically.

A further pyrotechnical approach is disclosed in published German patent application DE 10 2007 001 599, which provides a safety binding, ski binding, bindings and their foundation, characterized in that the skier can control, by means of radio signals in a wireless or wired manner, pyrotechnical propelling charges, telescope-like cartridges or relatively large explosive charges with great explosive power (up to about 6 g TNT) which act on the binding or its foundation, in order to free himself/herself from the binding of the ski by means of ignition.

Ski binding systems that can be released on purpose by the skier are known, i.a., from the following documents: U.S. Pat. No. 3,246,907 relates to a magnetic ski binding which can be released by the skier by applying a switch on a ski pole. The thus generated signal is transmitted by electrical conductors passing from the ski pole through the clothing and the ski boots to the bindings.

German patent DE 16 03 001 describes a ski binding comprising a release device that can be arbitrarily controlled by the skier by remote control, wherein the remotely controlled means consists of a battery-powered receiver which can be influenced by a battery-powered transmitter worn by the skier.

Published German patent application DE 22 19 415 discloses a ski binding in which a sole holder is held in the use position by means of a releasable locking means, wherein the locking means can be unlocked by means of an electric motor and the electric motor can be remotely controlled by a hand switch or a load sensor.

German patent DE 24 02 684 describes a release device for ski bindings which comprises a mechanical clamping device for clamping the boot of a skier to a ski, a transmitter which is attached to a ski pole and can be controlled by the skier, and a receiver which is attached to the ski and connected with the clamping device.

German patent DE 38 08 643 relates to an automatically releasable ski binding unit with interconnected front and heel parts, a mechanical boot holding system, an electronic control and a release system for the ski boot. The electronic release can be remotely controlled, which means that for leaving the ski binding it is only necessary to apply a remote-control element worn on the body.

European patent EP 0 228 599 discloses a release device for a locking mechanism of a jaw assembly of a ski binding, wherein the release device comprises a transmitter housed in a ski pole provided with a grip handle, a manual actuator disposed on the free end face of said grip handle of said ski pole so as to be immediately accessible from outside, and a switch operable by said manual actuator, and wherein the locking mechanism of said jaw assembly is releasable under the control of a receiver associated to said jaw assembly and selectively controllable by said transmitter. The manual actuator is arranged so as to be protected from involuntary actuation.

Since the trend in the touring and free-riding sector led to an increase in the market of 102% in the season 2003/2004—an Austrian producer alone registered an increase in the amount of products sold by almost 60% in the product segment of touring or hiking skis in the season 2003/2004—it can be assumed that there is a considerable demand for improved safety concepts.

It is the object of the present invention to provide an improved safety concept for winter sports, in particular for alpine and tour skiing, snowboards and the like.

SUMMARY

This object is achieved by a device and a method according to the claims.

The invention relates in particular to an emergency release system for one or more winter sports devices and/or pieces of winter sports equipment, such as skis, ski poles, snowboards, bindings and/or boots for skis or snowboards. It comprises a connection mechanism for detachably connecting at least two elements of one or more pieces of winter sports equipment. For a release, at least two elements, e.g. within one device such as within a binding, and also two elements of interconnected devices, e.g. a binding attached to a ski, can be disconnected. The connection mechanism is supported substantially radially in or on one of the two elements. Thus, a non-positive, positive and/or frictional radial support is possible, wherein a positive support is preferred. Moreover, there is provided a drive mechanism/drive means which can be activated from outside and is suited for cancelling the radial support of the connection mechanism and accordingly causing the two elements to separate.

Preferably, the connection mechanism is an essentially radially acting spring, more preferably a spring sheet or a spring washer. It can have a simple or relatively complex, combined shape. One portion can, e.g., be partly or completely ring-shaped, cylindrical, conical, truncated and/or pylon-shaped. Such a connection mechanism can be made, e.g., by primary forming or reshaping, cutting, bending and/or machining in a known manner. The dimensions such as, e.g., the sheet thickness and the external dimensions are selected such that deformation cannot be caused by a force achievable during normal skiing but by a force achievable by activating the drive mechanism.

Preferably, the connection mechanism has a proximal end having a first external dimension and a distal, more preferable, bent and/or cranked end having a second external dimension being larger than the first external dimension, wherein the distal end is supported substantially radially in or on one of the two elements. Particularly preferable is a pylon-shaped connection mechanism in which, however, the base surface that is common in pylons can be ring-shaped. Such a shape is advantageous in that it is possible to transmit via a conical portion a force from one of the connected elements to the other one of the connected elements in a straight manner, i.e. without considerable angles. Thus, it is further preferred that the connection mechanism has an intermediary portion whose external dimension increases at least in part continuously from the proximal to the distal end.

The drive mechanism preferably comprises pyrotechnical material which is enclosed preferably in the form of a pill or capsule, wherein the pill comprises about 15 to 150 mg, preferably about 27 to 100 mg, more preferably 30 mg of explosive and/or has a diameter of about 1 to 6 mm, preferably about 2 to 5 mm, more preferably about 3 to 4 mm. The pill and its seat are preferably structured such that after ignition they can be exchanged easily, wherein the further elements can preferably also be brought easily into their original position or exchanged easily.

The preferably small size or mass of the drive mechanism is advantageous in that the safety requirements can easily be met, so that the emergency release system according to the invention can be transported easily. Moreover, it is advantageous if covers for splinter protection are not necessary because of the small mass of the drive mechanism.

For using the relatively small explosive effect of the drive mechanism with preferably small mass effectively, it is preferable that seals reduce or prevent uncontrolled escape of the generated propellant gas. In addition or alternatively it is preferred if the parts to be moved in case of a release have a small mass for being able to accelerate the parts quickly so that a quick release system can be provided.

Moreover, the small size or mass of the drive mechanism is advantageous in that the system according to the invention can be constructed (around the drive mechanism) so as to be very small, i.e. the system according to the invention can also be realized as a retrofit component. For example, the system according to the invention can be integrated as an additional emergency release system in a holding strap of a known binding (e.g. ski binding or snowboard binding), with the fastener of the binding being maintained. Thus, a new construction of the binding can be avoided.

Preferably, the drive mechanism comprises a sleeve which is open at one side towards a piston and is preferably made of an expandable material, for example metal, wherein the drive mechanism is moreover arranged or designed such that it applies the piston when being activated. Preferably, a seal is provided which surrounds the sleeve, is located in a holding means and is arranged or designed such that the sleeve expands while or after the drive mechanism is activated and thus moves the seal outwards for further supporting a seal in the outward direction towards the holding means.

Preferably, the piston is designed or arranged such that it disconnects the connection mechanism after having been activated or applied. After having been activated or applied, it can slide at least over the intermediary portion of the connection mechanism and, as the movement continues, move the distal end of the connection mechanism inwardly and out of engagement. To this end, the piston is at least in part hollow, wherein the hollow portion should have an external dimension enabling the piston to slide over the proximal end of the connection mechanism without any severe problems but then, with the hollow portion, deforms at least a part of the intermediary portion of the connection mechanism preferably radially inwardly for also moving the distal end radially inwardly and finally, as the piston slides further over the intermediary portion of the connection mechanism, out of engagement for thus separating the elements connected by means of the connection mechanism.

Furthermore, it is possible to provide a guide tube which is to be assigned to one of the two elements to be connected, with or in which the connection mechanism engages, in which preferably the piston slides and which supports more preferably the seal radially outwardly. Thus, the mentioned parts can be brought in an operative connection within a minimum of space.

The drive mechanism can be activated preferably manually and/or automatically. The signals are transmitted electrically, electronically, acoustically and/or via infrared. The emergency release system is moreover designed or suitable for being activated together with or by activating a further safety system, such as an ABS avalanche airbag or the life jacket Avagear™. Thus, an integrated safety concept with an actuating or triggering means could be provided, wherein all chances for saving the person having an accident are used and it is particularly avoided that he/she gets anchored by his/her winter sports equipment. Thus, the above-mentioned principle of inverse segregation in granular flows can be used unhinderedly. As an alternative or in addition, the emergency release system can be brought in a release state by at least one trigger signal which is based on biological data (e.g. EEG, EMG) and/or triggered by voice control. In particular, in accordance with a preferred embodiment, a trigger signal can be triggered by voice or a voice command. For avoiding unintended activation, a voice recognition can recognize, e.g., a wording assigned to a trigger signal. As an alternative or in addition, the voice recognition can detect a "stress pattern" in the voice so that activation takes place preferably only in emergency situations.

The invention also relates to winter sports equipment, such as a ski binding, ski boot, ski pole and/or snowboard binding, comprising the emergency release system as described above and below.

Preferably, the invention is used in a heel restraint of a safety binding for skis, in which the emergency release system is inserted. On the one hand, after release of the emergency release system, a present adjusting spring can be again tensioned from outside by a further tensioning, preferably by an adjusting screw. On the other hand, it is also possible to release a possibly present binding or safety strap.

The heel restraint normally comprises a heel restraint jaw and the above-mentioned adjusting spring for adjusting the maximum holding force of the heel restraint jaw until binding-applied release. Preferably, the adjusting spring is supported directly or indirectly at least by the connection mechanism and, by activating a drive mechanism, cancels this support of the adjusting screw. The adjusting screw is thus unloaded and consequently the heel restraint jaw released.

A ski pole is preferably alternatively, more preferably additionally provided with an emergency release system according to the invention, wherein the emergency release system is suitable for separating a hand loop and/or a grip from at least one essential other part of the ski pole.

Also a snowboard binding can be provided with an emergency release system according to the invention, wherein the emergency release system is more preferably adapted to separate a locking strap of said binding.

The invention also relates to a method for emergency-releasing one or more pieces of winter sports equipment, such as skis, ski poles, snowboards, bindings and/or boots for skis or snowboards. According to said method, at least two elements of one or more pieces of winter sports equipment are connected by being supported substantially radially in or on one of the two elements. Moreover, the mechanism is activated from outside and the radial support is cancelled to thus cause the two elements to separate.

The invention moreover relates to a process for manufacturing an emergency release system for one or more pieces of winter sports equipment, such as skis, ski poles, snowboards, bindings and/or boots for skis or snowboards. According to said process, a connection mechanism for a detachable connection of at least two elements of one or more pieces of winter sports equipment is provided so that the connection mechanism is supported substantially radially in or on one of the two elements. Furthermore, a drive mechanism is provided, which can be activated from outside and is suitable for cancelling the radial support of the connection mechanism to thus cause the two elements to separate.

The system can be combined with a connection string which, in case of release, unwinds easily and facilitates recovery of the equipment or (in case the sportsman/sportswoman is buried but the equipment remains at the surface) the search for the buried person.

The present invention is primarily focused on an increase in the safety of alpine skiers, ski hikers, free-riders and snowboarders being outside a safe piste so that their risk of having a potential avalanche accident is increased.

The present invention discloses a pyrotechnical emergency release system, in particular for ski, ski pole and snowboard, which is reliable, can be realized relatively easily and cost-efficiently, can be electrically/electronically controlled and is compatible with sports equipment components available in the market.

Thus, the invention relates to an electrically controllable emergency release system which causes in particular in avalanche situations a pyrotechnical separation of ski boot and ski or hand and ski pole.

The invention further comprises the following features which are preferably realized:

- a very compact, light-weight and cost-efficient solution,
- an increase in the safety of skier and snowboarder being outside a safe piste (e.g. free-riders, ski hikers, etc.) and having an avalanche accident,
- a reduction in the risk of being buried,
- an increase in the safety of snowboarders caused by the electrically releasable binding in case of accidents in the open country in which it is not possible to open the binding manually,
- a possible simultaneous release at both legs and/or both ski poles, the invention can be realized so as to be compatible with present binding systems and can be added thereto (without changing the ski or snowboard binding considerably), the pyrotechnical release device for the bindings of touring skis and snowboards can include separation of the binding strap when being released, the pyrotechnical emergency release system can be combined with ABS avalanche airbags available in the market (in these systems—http://www.abs-lawinenairbag.de—a pressurized air cartridge is opened in an electrically controlled manner by pulling an actuating handle, and a balloon system is inflated. The activation signal used for this release operation might simultaneously be used for triggering the emergency release of the present invention), an electronic activation is probably only possible once because afterwards the explosive or propellant charge has to be exchanged. After an emergency release, the functionality of the ski binding can easily be restored manually and the binding strap can be easily inserted. Ski pole and snowboard binding can easily be reassembled manually, the pyrotechnical propelling charge (e.g. pill) and the related explosive force can be kept small in order to meet safety standards. The preferably small explosive force can be used effectively by using seals and/or a small mass (low inertial force) of the parts to be moved (piston, cylinder), so that the parts to be moved in case of release can be quickly accelerated to thus provide an extremely quick release system. Preferably, the system according to the invention operates so quickly that the release mechanism can be opened within about 1 ms.

BRIEF DESCRIPTION OF THE DRAWINGS

The Figures show preferred embodiments of the invention by way of examples.

DETAIL DESCRIPTION OF ILLUSTRATIVE EMBODIMENTS

In the following, two technical embodiments are mentioned particularly and exemplarily. These embodiments are compatible with available binding systems and, therefore, can be added thereto without changing the existing safety binding decisively. In case of release, in both variants the part to be separated is unlocked in that the support/abutment of an adjusting or locking spring is cancelled by a movable cylinder which can be driven by a pyrotechnical propelling charge. The adjusting or locking spring is thus unloaded and the lock is unlocked. The moved cylinder deforms a spring sheet by means of which the support is held. In the first embodiment, the spring sheet is conical and the adjusting or locking spring is unloaded in the direction of movement of the moved cylinder. In the second embodiment, the spring sheet is plane and the adjusting spring is unloaded contrary to the direction of movement of the moved cylinder.

Figure 1:
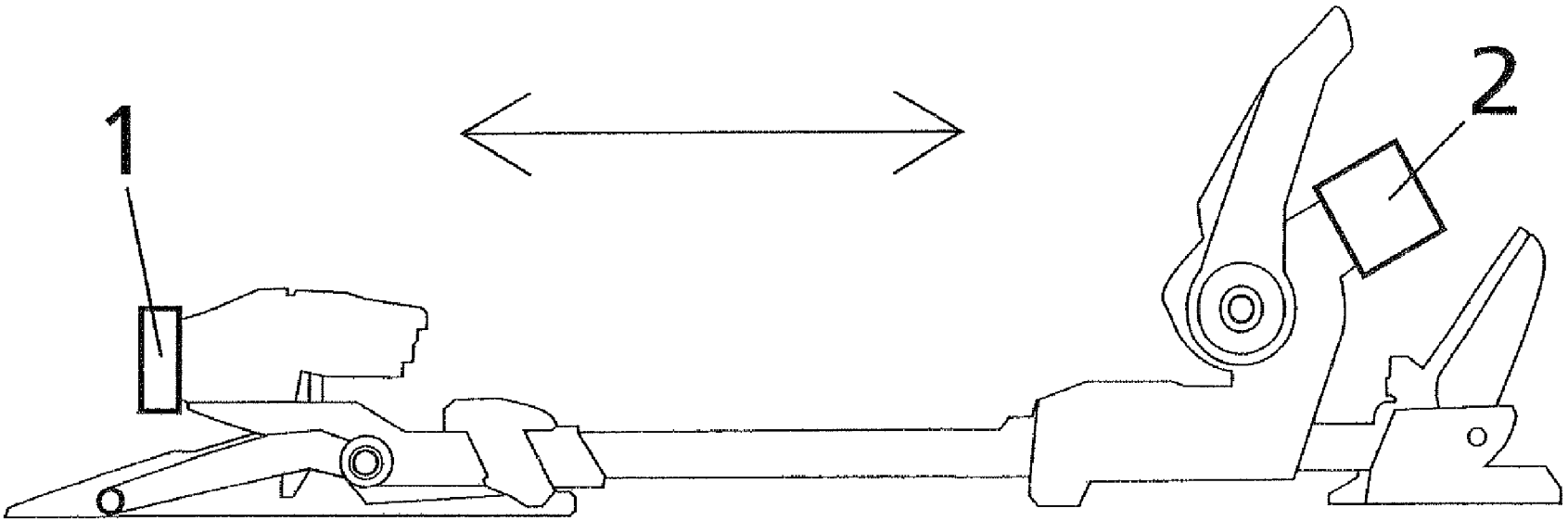
FIG. 1 shows a known safety binding for skis which is, however, further configured in accordance with the invention.
Figure 2:
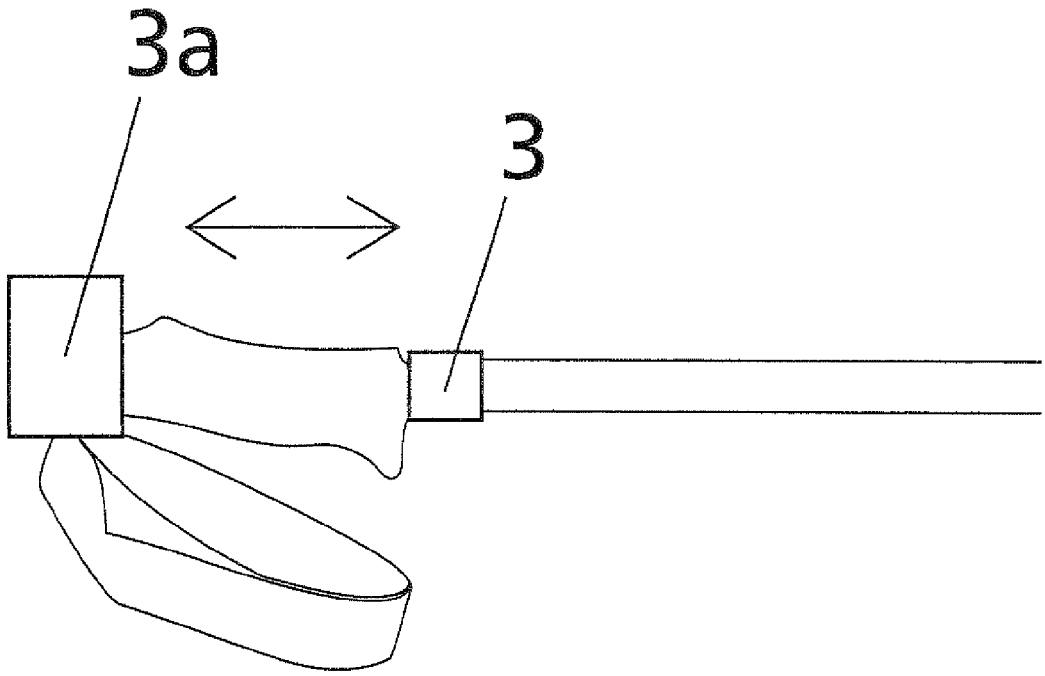
FIG. 2 shows a known ski pole which is, however, further configured in accordance with the invention.

FIG. 1 shows possible positions 1 and 2 of the release device. The position of the pyrotechnical release device in the ski pole (it can also be realized in both embodiments) is illustrated in FIG. 2. Here, too, two positions are possible. A separation is conceivable directly below the handle 3 or at the pole loop or at the connection to the glove 3*a*.

Figure 3:
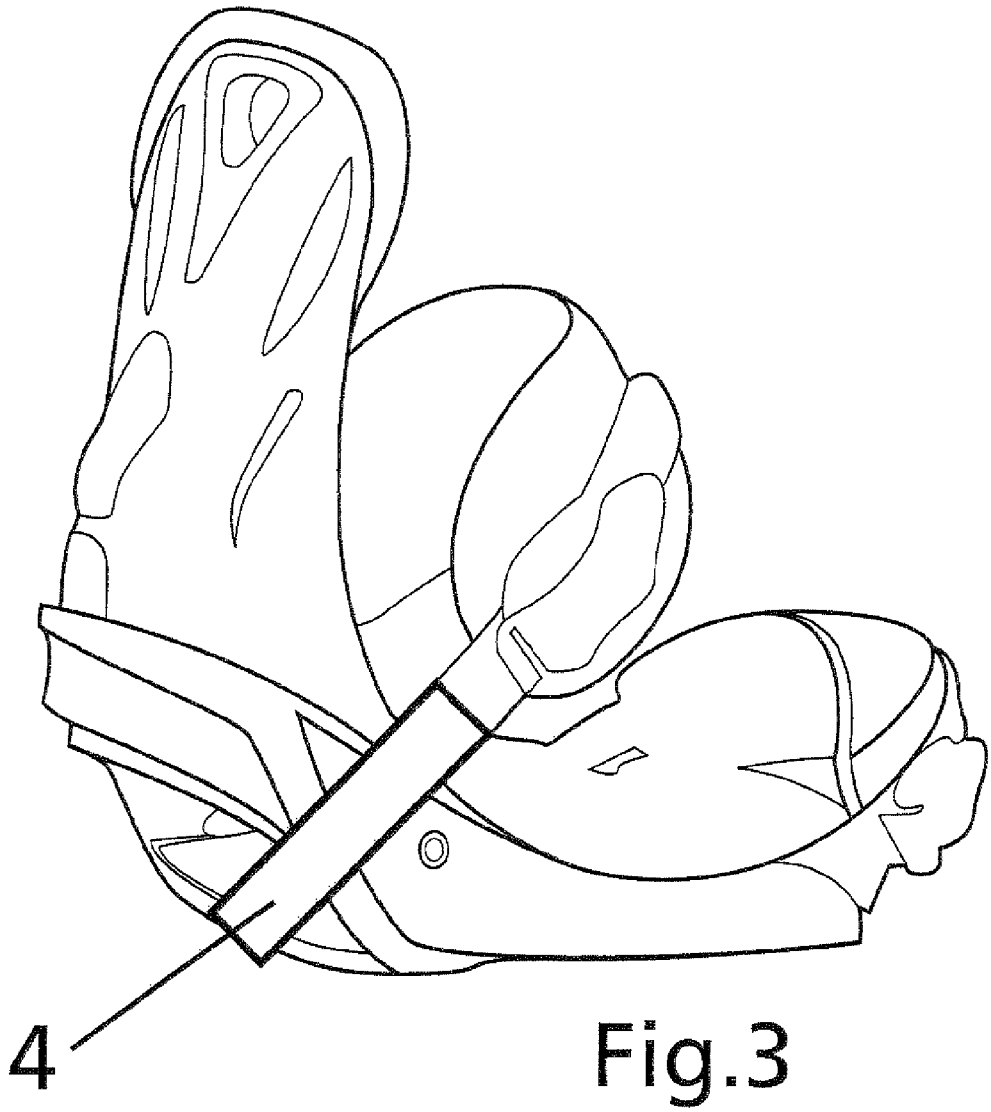
FIG. 3 shows a known snowboard binding which is, however, further configured in accordance with the invention.

A possible position of the pyrotechnical release device of a snowboard binding (here, too, it can be realized in accordance with both embodiments) is shown in FIG. 3.

Figure 4:
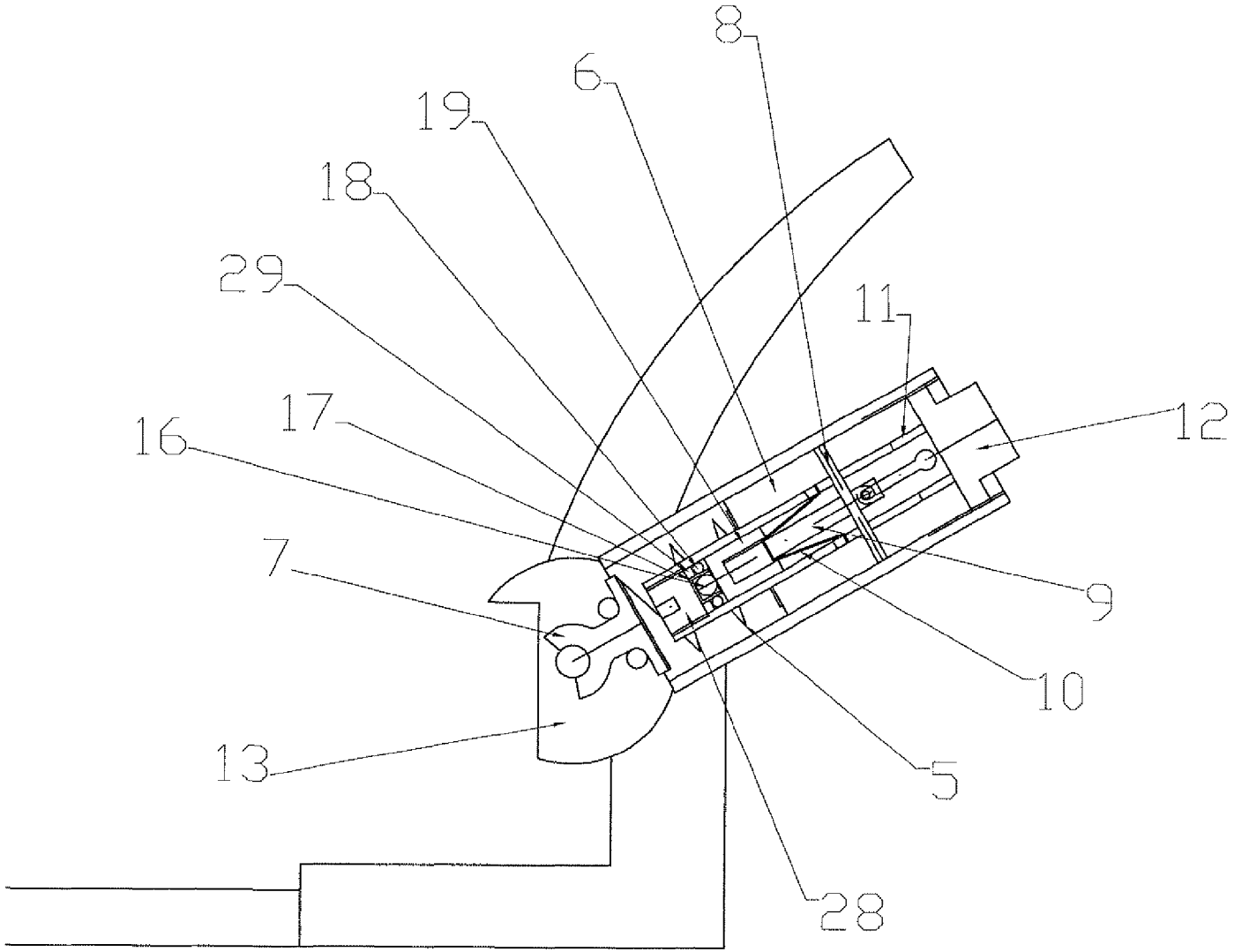
FIG. 4 shows a heel restraint of a safety binding for skis comprising an emergency release system according to an embodiment of the invention.

FIG. 4 shows an embodiment of the heel retainer of a ski binding. The heel retaining jaw 13 is shown. The adjusting spring 5 is clamped between the ring-shaped support 6 and the connecting member 7 of the binding. The support 6 is held by the bolt 8 which can slide in the slotted guide tube 11. The position of the blot 8 is fixed by the rod 9 at which the spring sheet 10 is mounted. The bent end of the spring sheet 10 can be locked in a slot of the guide tube 11. The guide tube 11 is axially movable by the adjusting screw 12 and thus the adjusting spring 5 can be loaded.

In case of release, the pyrotechnical pill 16 can be ignited. The pill 16 is located in a thin metal sleeve 17 sealed by an O-ring 18. The metal sleeve 17 and the O-ring 18 are fixed by means of a holder 29 by the screw 28. The generated propelling gas can move the cylinder 19 axially outwardly, the bent end of the spring sheet 10 can be moved radially inwardly and thus decoupled from the guide tube 11, the support 6 can be moved axially outwardly, and the adjusting spring 5 can be unloaded. In other words, the generated propelling gas can cause the spring or the spring sheet 10 to be deformed so that decoupling can take place. Preferably, the pyrotechnical pill 16 is as small as possible so that the explosive effect is accordingly small. Thus, safety standards can be met accordingly easily. For using the preferred small explosive force effectively, it is particularly advantageous if seals (e.g. O-ring 18) are provided for reducing or preventing uncontrolled escape of the propelling gas so that the propelling gas can move the cylinder 19 effectively. Moreover, it is preferred if the mass of the cylinder 19 is small (small inertial force), so that the cylinder can be accelerated effectively and preferably quickly and consequently an extremely quick release system is provided. For example, the overall time for a pill-driven stroke of a cylinder 19 of 1.7 cm is about 1.2 ms. This time is the sum of the burning time of the pill 16 (time until the pressure wave is formed) of 0.7 ms and the time for movement of the cylinder 19 of 0.5 ms.

Figure 5:
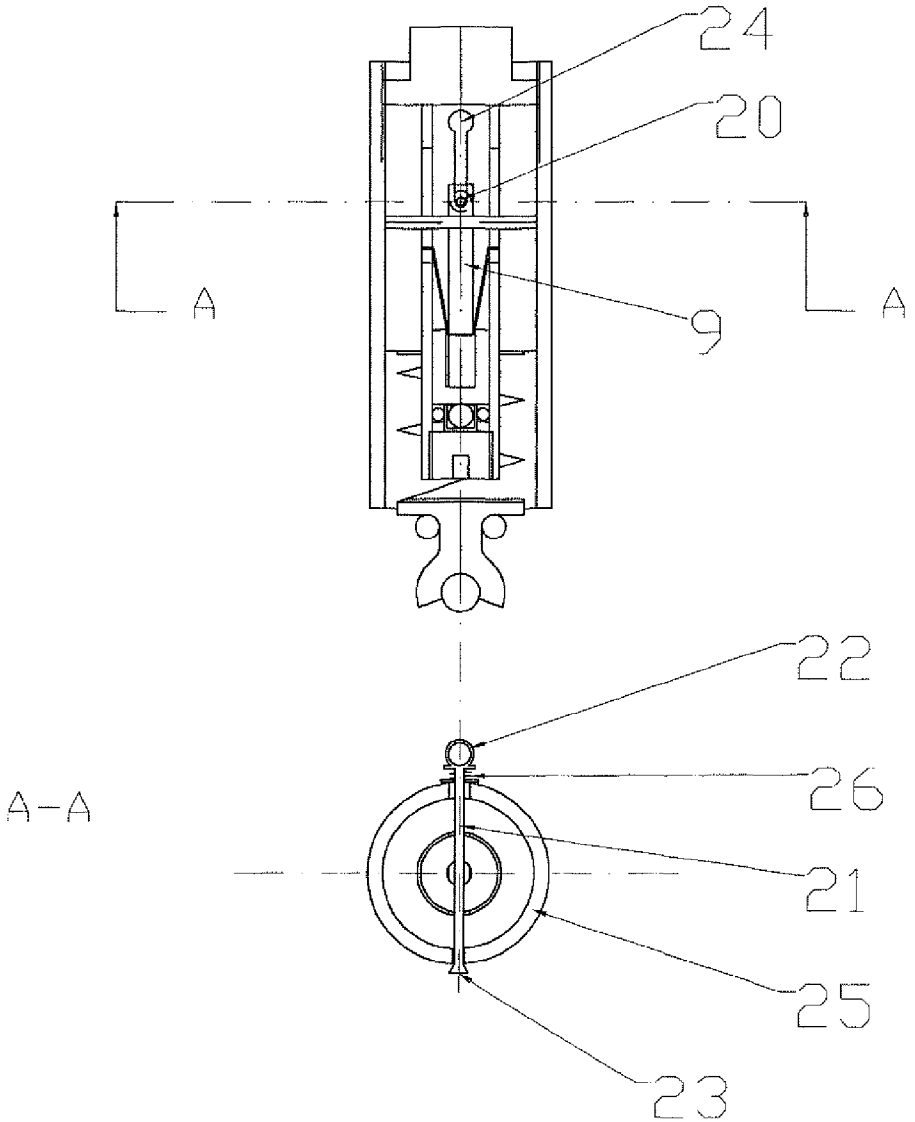
FIG. 5 shows a further embodiment of a heel restraint of a safety binding for skis according to the invention.

One end of the rod 9 comprises the cross bore 20 (FIG. 5) through which the rod 21 extends. This rod 21 has at its one end the eye 22 with the binding strap and at the other end the widening 23. In the electronically non-activated state, the narrow gap of the outer tube 25 and the widening 23 keep the rod 21 and the eye 22 in their position. After the electronic activation, the rod 21 can be moved, driven by the spring 26, through the enlarged gap 24, and the binding strap can be released from the heel restraint.

After the electronic activation, the adjusting spring 5 can be loaded by axially moving the guide tube 11 by the adjusting screw 12, so that the heel restraint can be used with mechanical release device.

Figure 6:
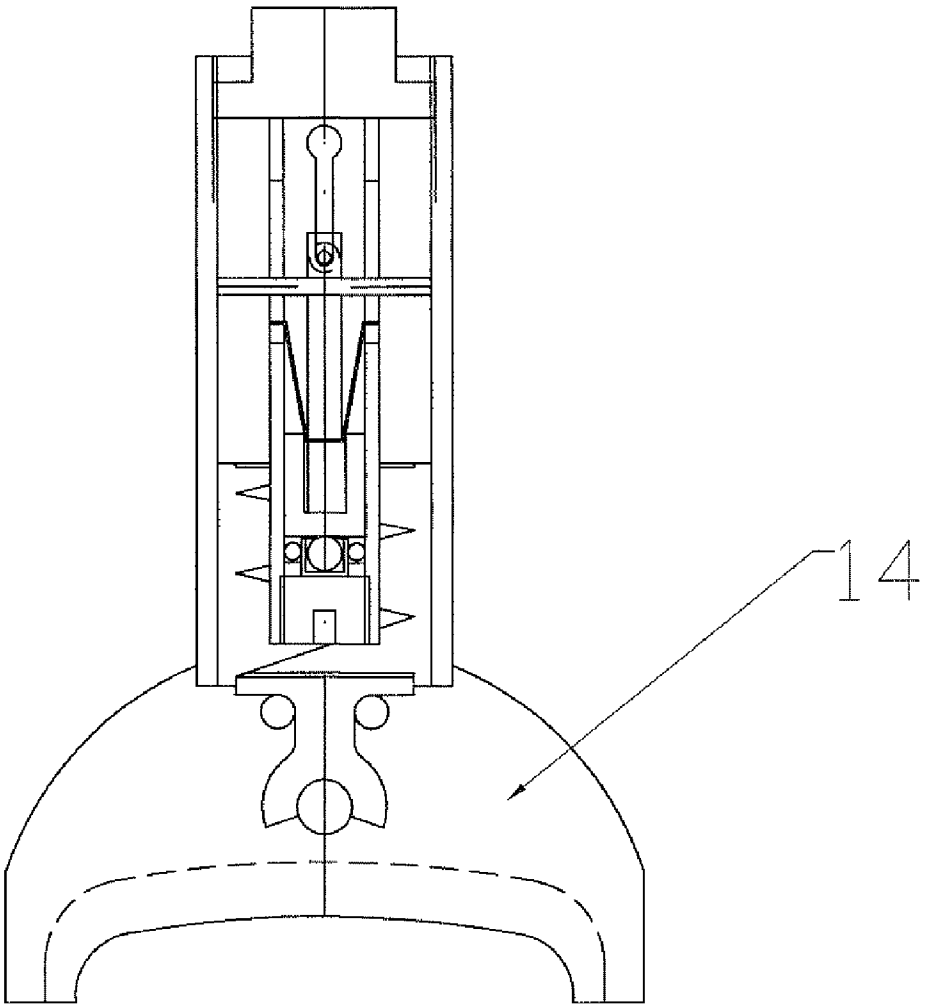
FIG. 6 shows a further embodiment of a sole restraint of a safety binding for skis according to the invention.

FIG. 6 shows an embodiment mounted into the sole restraint of a ski binding. The sole restraint jaw 14 is shown.

Figure 9:
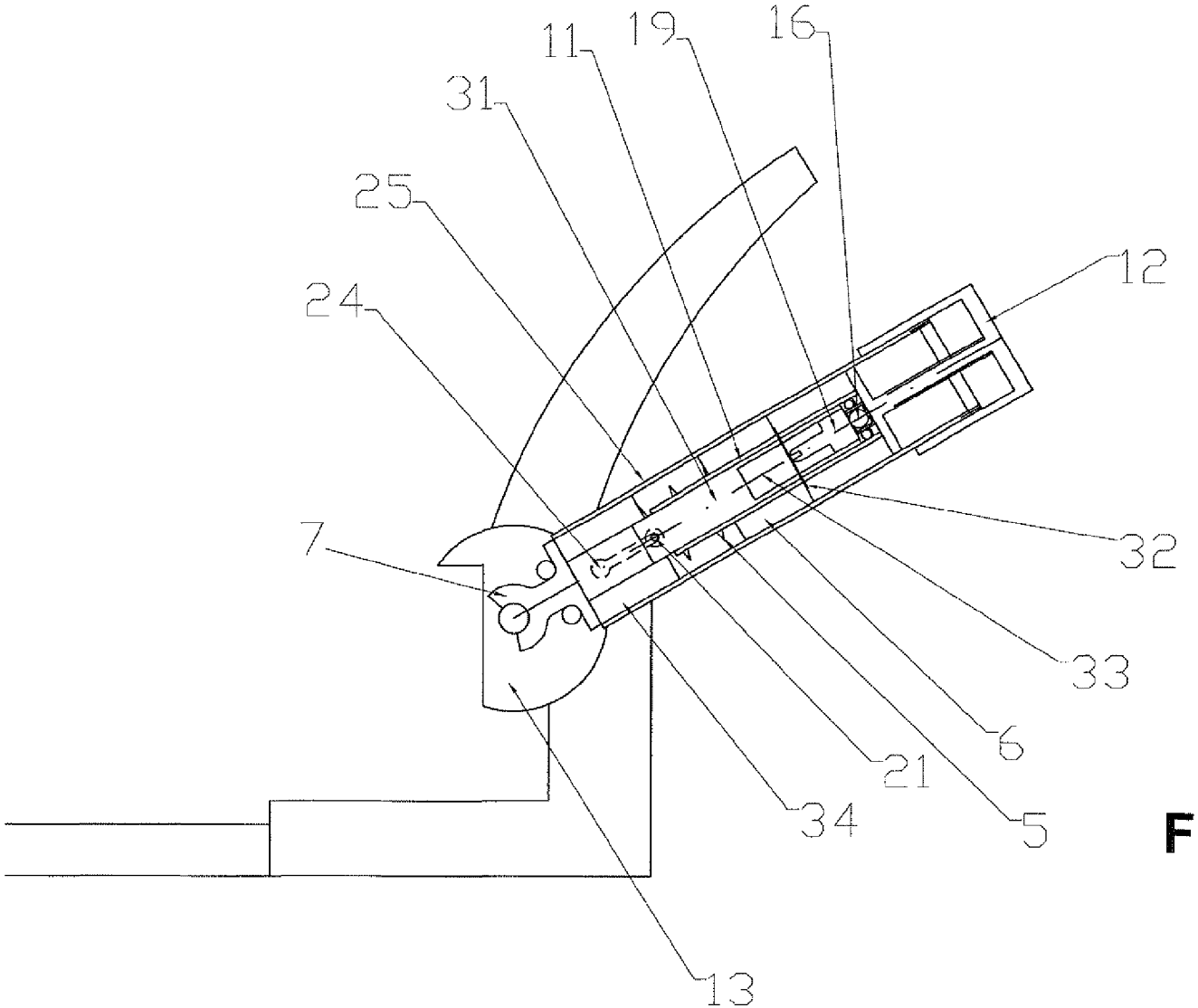
FIG. 9 shows a further embodiment of a heel restraint of a safety binding for skis according to the invention.

FIG. 9 shows an embodiment of the heel restraint of a ski binding. The heel restraint jaw 13 is shown. The adjusting spring 5 is clamped between the ring-shaped support 6 and the ring-shaped support 34 resting on the connecting member 7. The support 6 is held by the spring sheet 32 lying in a slot of the guide tube 11 transversely with respect to the guide tube 11. The guide tube 11 can be moved axially by the adjusting screw 12 and thus the adjusting spring 5 can be loaded. In case of release, the movable cylinder 19, whose narrow, rounded projection is connected with the spring sheet 32, can be moved axially inwardly by the propelling gas of the pyrotechnical pill 16, the spring sheet 32 can be moved by the projection of the cylinder 19 into the bore 33 of the rod 31 and thus can be decoupled from the support 6, the support 6 can be moved axially outwardly, and the adjusting spring 5 can be unloaded. The generated propelling gas thus causes the spring sheet 32 to be deformed so that decoupling can take place. According to a preferred embodiment, the pyrotechnical pill is as small as possible in order to meet safety standards. For using the corresponding small explosive force effectively, it is particularly advantageous if seals are provided for reducing or preventing uncontrolled escape of the propelling gas, so that the propelling gas can move the cylinder 19 effectively. Moreover, it is preferred if the mass of the cylinder 19 is small (small inertia) so that the cylinder can be accelerated effectively and preferably quickly and consequently an extremely quick release system is provided. A quick release system is advantageous in particular for bindings of downhillers.

By moving the rod 31, the rod 21 at which the binding strap is attached can be moved axially inwardly, where the rod 21 with the binding strap can be released from the heel restraint because of the enlarged gap 24 of the outer tube 25.

After the electronic activation, the adjusting spring 5 can be loaded by axially moving the guide tube 11 by the adjusting screw 12, so that the heel restraint can be used with mechanical release device.

Figure 7:
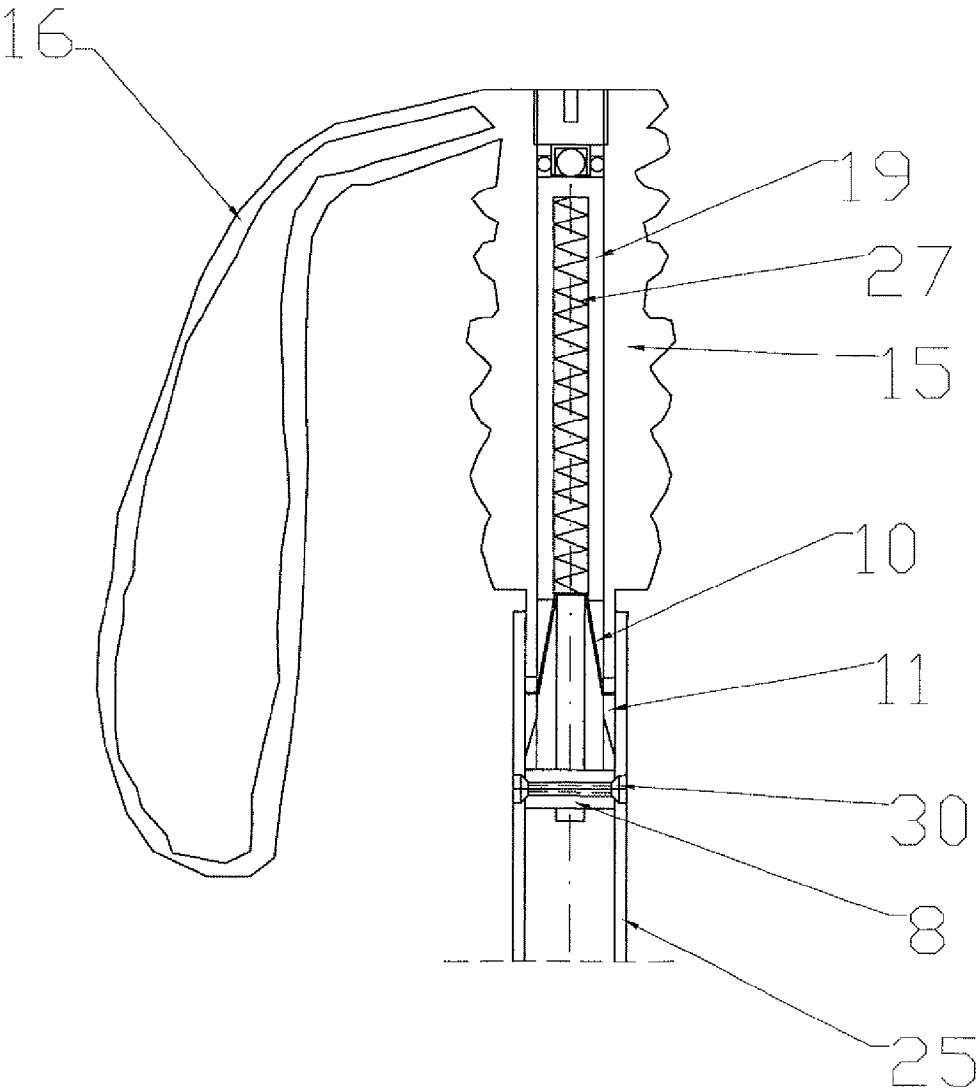
FIG. 7 shows a further embodiment of a ski pole according to the invention.

FIG. 7 shows the electronically controllable release device in a ski pole (position 3). The grip 15 with the guide tube 11 at the lower end and the loop 16 are shown. The locking spring 27 is located within the movable cylinder 19. The bolt 8 is connected by means of two screws 30 with the outer tube 25, i.e. the ski pole. Upon electronic activation, the spring sheet 10 can be decoupled from the guide tube 11 by the downwardly moved cylinder 19, and the outer tube 25 can be moved downwardly away from the grip 15 by the cylinder 19 and the locking spring 27.

After the electronic activation, the outer tube 25 can be moved, against the spring force of the locking spring 27, over the guide tube 11, and the spring sheet 10 can be locked in the guide tube 11.

In case of separation at the loop or the glove connection eye (3*a*), the locking systems provided by the pole manufacturer can be actuated, e.g. by removing the present spring support by means of the pyrotechnical activation.

Figure 8:
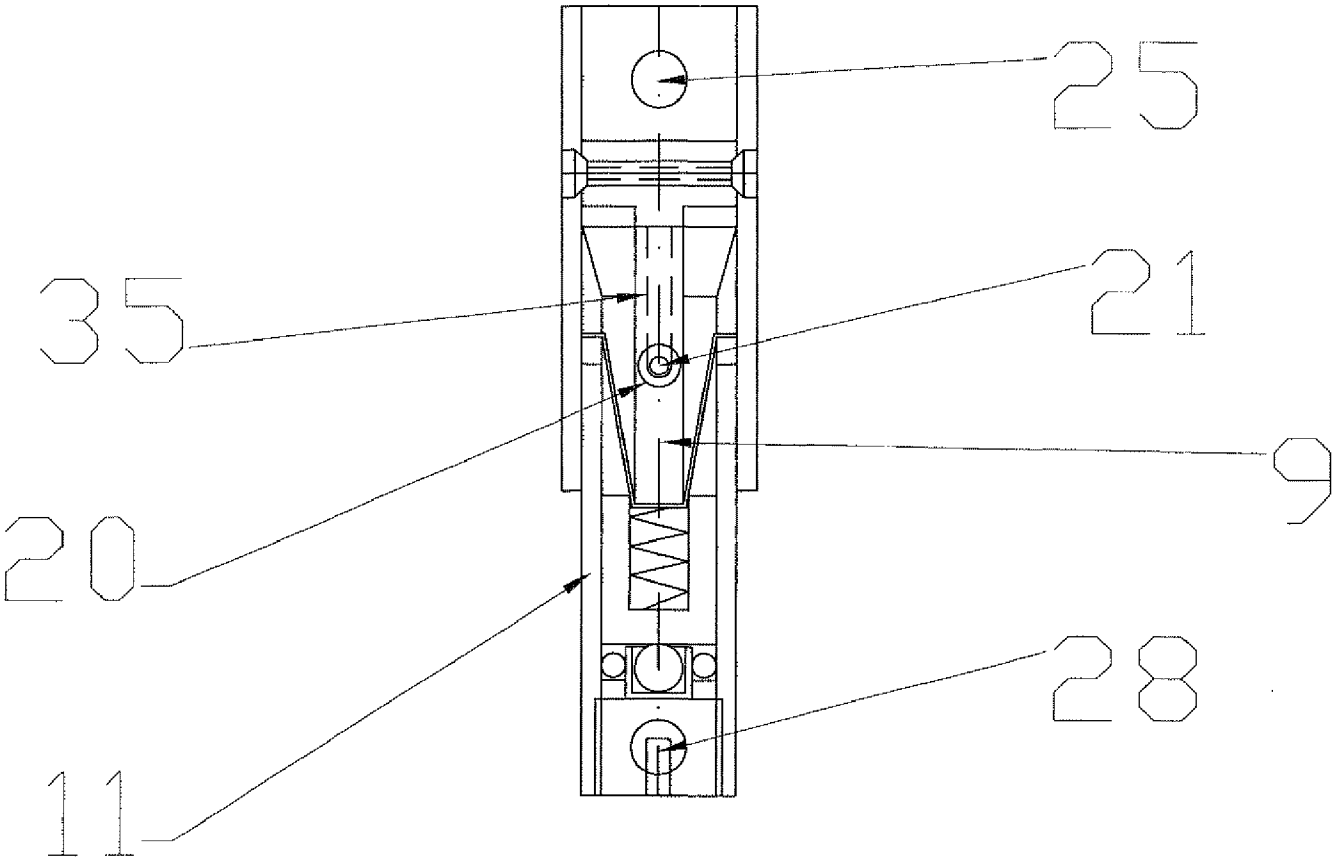
FIG. 8 shows a further embodiment of a snowboard binding according to the invention.

FIG. 8 shows the electronically controllable release device, which is derived from the release device of the ski pole, in a snowboard binding. A hole is drilled through the screw 28 and the outer tube 25 for the lower and upper suspension. The rod 21, which comprises at one end the binding strap and at the other end the widening, extends through the transverse bores 20 of the rod 9 and the outer tube 25 and is held by the narrow gap 35 in the guide tube 11. After the electronic activation, the rod 21 can be moved through the narrow gap 35 away from the guide tube 11 and can be separated, driven by the spring 26 (FIG. 5), from the outer tube 25 through the transverse bores 20.

The disclosure of the prior art discussed above is incorporated for realizing individual aspects of the present invention.

The invention also comprises individual features in the Figures, even if they are shown therein in connection with other features and/or if they are not mentioned above or below.

The invention also comprises embodiments with any combination of features which are mentioned or shown above or below in connection with different embodiments.

The invention also comprises the exact terms, features, numerical values or ranges, etc, if these terms, features, numerical values or ranges are mentioned above or below in connection with expressions such as "about, circa, approximately, substantially, generally, at least, not less than" etc, (e.g. "about 3" should also comprise "3" or "substantially radial" should also comprise "radial"). The expression "respectively" also means "and/or".

The invention claimed is:

1. An emergency release system for one or more pieces of winter sports equipment, comprising:

(a) a connection mechanism for detachably connecting at least two elements of one or more pieces of winter sports equipment, (b) wherein the connection mechanism is supported substantially radially in or on one of the two elements, (c) and a drive mechanism comprising pyrotechnical material, which can be activated from outside and is suited for cancelling the radial support of the connection mechanism, to separate the two elements.

2. The emergency release system according to claim 1, wherein the connection mechanism is a substantially radially acting spring.

3. The emergency release system according to claim 1, wherein the connection mechanism is a spring sheet.

4. The emergency release system according to claim 1, wherein at least one portion of the connection mechanism is partly or completely ring-shaped, cylindrical, conical, truncated or pylon-shaped.

5. The emergency release system according to claim 1, wherein the connection mechanism has a proximal end having a first external dimension and a distal, bent or cranked end having a second external dimension being larger than the first external dimension, wherein the distal end is supported substantially radially in or on one of the two elements.

6. The emergency release system according to claim 5, wherein the connection mechanism comprises an intermediary portion whose external dimension increases at least in part continuously from the proximal to the distal end.

7. The emergency release system according to claim 6, wherein after having been activated or applied, the piston can slide at least over the intermediary portion of the connection mechanism and, as the movement continues, moves the distal end of the connection mechanism inwardly and out of engagement.

8. The emergency release system according to claim 1, wherein the drive mechanism with the pyrotechnical material is enclosed in the form of a pill or capsule.

9. The emergency release system according to claim 8, wherein the pill comprises about 15 to 150 mg, preferably about 27 to 100 mg, more preferably 30 mg of explosive or has a diameter of about 1 to 6 mm, preferably about 2 to 5 mm, more preferably about 3 to 4 mm.

10. The emergency release system according to claim 1, wherein the drive mechanism comprises a sleeve which is open at one side towards a piston and is preferably made of an expandable material, for example metal, wherein the drive mechanism is moreover arranged or designed such that it applies the piston when being activated.

11. The emergency release system according to claim 10, wherein a seal is provided which surrounds the sleeve, is located in a holding means and is arranged or designed such that the sleeve expands while or after the drive mechanism is activated and thus moves the seal outwards for further supporting a seal in the outward direction towards the holding means.

12. The emergency release system according to claim 11, wherein further a guide tube is provided, which is to be assigned to one of the two elements to be connected, with or in which the connection mechanism engages, in which preferably the piston slides and which supports more preferably the seal radially outwardly.

13. The emergency release system according to claim 10, wherein the piston is designed or arranged such that it disconnects the connection mechanism after having been activated or applied.

14. The emergency release system according to claim 1, wherein the drive mechanism can be activated manually or automatically, preferably electrically, electronically, acoustically or via an infrared signal, preferably alternatively or in addition also by at least one trigger signal which is based on biological data (e.g. EEG, EMG) or triggered by voice control.

15. The emergency release system according to claim 1, wherein the emergency release system is moreover designed or suitable for being activated together with or by activating a further safety system.

16. A ski binding, ski boot, ski pole or snowboard binding comprising an emergency release system according to claim 1.

17. The ski binding according to claim 16 comprising a heel restraint in which the emergency release system is inserted.

18. The ski binding according to claim 17, wherein the heel restraint comprises a heel restraint jaw and an adjusting spring for adjusting the maximum holding force of the heel restraint jaw until release, wherein the adjusting spring is supported directly or indirectly at least by the connection mechanism and, by activating the drive mechanism, cancels the support of the adjusting spring, unloads the adjusting spring and thus releases the heel restraint jaw.

19. The ski binding according to claim 18, wherein after releasing the emergency release system, the adjusting spring can be again tensioned from outside, preferably by an adjusting screw.

20. The ski binding according to claim 17, wherein the emergency release system is moreover arranged or configured for also releasing or separating a present binding strap.

21. A ski pole comprising an emergency release system according to respective preceding claims, wherein the emergency release system is adapted to separate a hand loop or a grip from at least one essential remaining part of the ski pole.

22. A snowboard binding comprising an emergency release system according to claim 1, wherein the emergency release system is adapted to separate a locking strap.

23. A method for releasing one or more pieces of winter sports equipment, including skis, ski poles, snowboards, bindings or boots for skis or snowboards, comprising an emergency release system according to claim 1, comprising the steps of connecting at least two elements of one or more pieces of winter sports equipment by supporting substantially radially in or on one of the two elements and activating from outside and cancelling the radial support, accordingly causing the two elements to separate.

24. A process for manufacturing an emergency release system for one or more pieces of winter sports equipment, including skis, ski poles, snowboards, bindings or boots for skis or snowboards, comprising an emergency release system according to claim 1, comprising the steps (a) providing a connection mechanism for detachably connecting at least two elements of one or more pieces of winter sports equipment, (b) so that the connection mechanism is supported substantially radially in or on one of the two elements, (c) and providing a drive mechanism, which can be activated from outside and is suited for cancelling the radial support of the connection mechanism, accordingly causing the two elements to separate.

* * * * *

UNITED STATES PATENT AND TRADEMARK OFFICE

CERTIFICATE OF CORRECTION

PATENT NO. : 8,403,354 B2
APPLICATION NO. : 12/864443
DATED : March 26, 2013
INVENTOR(S) : Senner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 274 days.

Signed and Sealed this
First Day of September, 2015

Michelle K. Lee

Michelle K. Lee
*Director of the United States Patent and Trademark Office*